US008261415B2

(12) United States Patent
Poole et al.

(10) Patent No.: US 8,261,415 B2
(45) Date of Patent: Sep. 11, 2012

(54) APPARATUS FOR COTTON GINNING, PROCESSES AND METHODS ASSOCIATED THEREWITH

(76) Inventors: Daniel Alexander Poole, Lewisville, NC (US); Wesley Wade Burgess, Lewisville, NC (US); Jon P. Rust, Cary, NC (US)

( * ) Notice: Subject to any disclaimer, the term of this patent is extended or adjusted under 35 U.S.C. 154(b) by 530 days.

(21) Appl. No.: 11/992,500

(22) PCT Filed: Sep. 29, 2006

(86) PCT No.: PCT/US2006/038427

§ 371 (c)(1),
(2), (4) Date: Aug. 12, 2010

(87) PCT Pub. No.: WO2007/041492

PCT Pub. Date: Apr. 12, 2007

(65) Prior Publication Data

US 2010/0293756 A1 Nov. 25, 2010

Related U.S. Application Data

(60) Provisional application No. 60/721,444, filed on Sep. 29, 2005.

(51) Int. Cl.
*D01B 1/04* (2006.01)

(52) U.S. Cl. ..... 19/48 R

(58) Field of Classification Search ..... 19/39, 48 R, 19/49, 244, 245, 247, 248
See application file for complete search history.

(56) References Cited

U.S. PATENT DOCUMENTS 35,708 A * 6/1862 Sanford ..... 19/7
442,735 A * 12/1890 Stewart ..... 19/6
679,164 A * 7/1901 Allison ..... 19/10
(Continued)

FOREIGN PATENT DOCUMENTS

CN 1219210 6/1999
(Continued)

OTHER PUBLICATIONS

The State Intellectual Property Office of the Peoples Republic of China, Office Action, Application No. 200680044482, dated Jan. 22, 2010.

(Continued)

*Primary Examiner* — Shaun R Hurley
(74) *Attorney, Agent, or Firm* — Kilpatrick Townsend & Stockton LLP

(57) ABSTRACT

An apparatus and method for cotton ginning are disclosed. For example, an apparatus for cotton ginning comprises a belt and one or more rollers which are operatively connected. The belt is configured to have a contoured surface such that unprocessed cotton is processed so that cotton seeds are separated from cotton fiber, with the cotton fiber being held by the contoured surface. A method of cotton ginning comprises feeding unprocessed cotton into an apparatus that contains at least two belts wherein two of the at least two belts are operatively connected to each other so as to generate an arced contour and wherein the arced contour applies a normal force to cotton fibers allowing separation of the cotton fibers from cotton seeds.

20 Claims, 12 Drawing Sheets

U.S. PATENT DOCUMENTS

| | | | | | |
|---|---|---|---|---|---|
| 2,118,071 | A | * | 5/1938 | Decuypere et al. | 19/19 |
| 2,924,854 | A | | 2/1960 | Boer | |
| 2,979,782 | A | * | 4/1961 | Boer | 19/201 |
| 3,778,995 | A | * | 12/1973 | Sanders | 57/315 |
| 3,806,991 | A | * | 4/1974 | Sanders | 19/244 |
| 4,070,732 | A | * | 1/1978 | Herubel | 19/236 |
| 4,914,786 | A | | 4/1990 | Vandergriff | |
| 6,115,887 | A | | 9/2000 | Riter | |
| 6,161,441 | A | * | 12/2000 | Ghorashi et al. | 73/863.92 |

FOREIGN PATENT DOCUMENTS

| | | |
|---|---|---|
| CN | 2345546 | 10/1999 |

OTHER PUBLICATIONS

The State Intellectual Property Office of the Peoples Republic of China, Office Action, Application No. 200680044482, dated Dec. 27, 2010.

Patent Cooperation Treaty, International Search Report, International Application No. PCT/US06/38427, dated Aug. 29, 2007.

Patent Cooperation Treaty, Written Opinion, International Application No. PCT/US06/38427, dated Aug. 29, 2007.

* cited by examiner

Comparative Embodiment

Comparative Embodiment

Comparative Embodiment

Comparative Embodiment

APPARATUS FOR COTTON GINNING, PROCESSES AND METHODS ASSOCIATED THEREWITH

The present invention claims priority under 37 CFR 1.119 (e) to U.S. provisional patent application 60/721,444, filed Sep. 29, 2005 the entire contents of which are incorporated herein by reference.

FIELD OF THE INVENTION

The present invention relates to an apparatus for cotton ginning, processes and methods associated therewith.

BACKGROUND OF THE INVENTION

World cotton production is estimated at 24.7 million tons in 2005/06, which represents a 5.7% decline over the 2004-2005 season, while world consumption in 2006 is projected to rise to a new all-time high of 25.5 million tons, an increase of 1.7 million tons or 7.4% from last season. The use of cotton, wool, and silk increased 7.0% to 26.8 million tons in 2005, a growth rate over four times than that of man made fiber use. From these figures, it should be apparent that cotton consumption is exceeding production. Moreover, the equilibrium price of stock has increased as seen in the Cotlook A Index (from about $0.50/lb at the beginning of the 2005 to $0.60 in the fourth quarter of 2005). The United States produced 23.9 million bales of mostly American Upland Cotton in 2005 at an average price per pound of $0.56. At 480 pounds per bale, the U.S. cotton industry represents a $6.4 billion market. The International Fiber Journal also forecasts world cotton area for 2005/06 at 34.7 million hectares, down 3.1% from 2004/05. Additionally, cotton yields declined from 732 kg/hectare in 2004/05 to 712 kg/hectare in the current season. Changes in the cultivated area and yield pose reliable planning issues for the downstream spinning industry and a threatened means of existence to farmers.

The average cotton farmer targets cotton fiber length to be produced at 34/32 inches. If the average cotton fiber length is 33/32 inches or less the fiber doesn't command the premium of its longer (35/32 in.) cousin. An opportunity exists for a new technology to allow farmers, by replacing only their gins, to increase yield by approximately 7% and command a premium due to long staple length of fibers that might be produced by a new gin from the same seed cotton. This increased fiber length combined with comparable or better yield will ensure the farmer competitiveness and likely increase profits.

The cotton saw gin was developed in 1794 by Eli Whitney as a way of separating the useful cotton fiber from the cotton seeds (which are not used in cotton products). Only a few improvements have been made to the cotton gin since Eli Whitney's saw gin. Prior to the development of the saw gin, the roller gin (see FIG. 4) was used and most acknowledge that it was the first mechanical device used for ginning cotton. The roller gin used two rollers similar to a latter-day clothes wringer that pinched and pulled cotton fibers from cotton seeds. This allowed production of cotton fibers on the order of about 5 pounds of lint per day. This roller gin or "churka" was the primary ginning tool until Eli Whitney patented the saw gin in 1794.

Whitney's saw gin removed seeds from the cotton fibers with a spiked cylinder that pulled the lint through wooden slots too narrow for the seeds to pass through. The saw gin was 50-100 times faster than hand ginning. It was especially effective in separating the hard to remove seeds in Upland cotton, making these short staple cottons more economical to produce than previously. Improvements were subsequently made to Whitney's saw gin such as replacing the spikes in Whitney's saw gin with circular serrated saws that have made it more effective for separating seed and fiber. The process of saw ginning is shown in FIGS. 2 and 3*a-d*. In FIG. 2, the raw cotton goes in a slot and the seeds drop through the slot and cotton fibers are blown out. In 3*a*, the saw teeth rotate to hook fibers and strip seeds. In 3*b* the fibers on the saw teeth are pulled through slots. 3*c* shows the seeds that are stripped of fiber as the fall out the slot. FIG. 3*d* shows a rapidly revolving brush that sweeps the fibers off the saw teeth while forced air blows fibers off the brushes out the gin. Subsequent improvements of Whitney's saw gin have allowed the production of about 15 bales of lint per hour per stand.

The saw gin was (and is) much faster than the roller gin but it did not replace the roller gin entirely. Although the roller gins cotton more slowly, it is gentler to the cotton than the saw gin. The saw gin possesses serrated saws that tend to break more of the cotton fibers. Roller gins, although slower, continue to be used for ginning Pima cotton to protect the extra-long staple or length, a desirable quality that increases the value of the cotton fiber.

The roller gin continued to be used for ginning extra-long-staple cottons, but its low ginning rate made it too expensive to maintain and operate. In an effort to increase its ginning capacity, several gins were developed that improved the roller ginning rate, though these improvements did not dramatically improve the ginning rate. It wasn't until the 1960's, when the rotary-knife gin was developed at the Southwestern Cotton Ginning Research Laboratory in cooperation with gin manufacturers and private ginneries, that roller gins became more efficient and less expensive to operate.

The rotary-knife gin improved on the McCarthy gin invented by Fones McCarthy in 1840. It retained the McCarthy Gin's ginning roller and stationary knife, but replaced its reciprocating knife with a rotary knife that greatly increased the roller ginning rate. Compared to the McCarthy Gin which produces only ¼ bale of lint an hour per stand, the rotary-knife gin can produce up to 1½ bales of lint an hour per stand. The McCarthy roller gin uses a method of positioning a stationary knife tightly against a ginning roller and a reciprocating knife blade to dislodge the seed from a pinch point. Nevertheless, even with subsequent improved methods that increased the speed of feeding the machine, the McCarthy rotary-knife gin still suffered the drawback of low capacity. The subsequent introduction of the rotabar in the 1960s allowed the production rate of the roller gin increased to a rate of about two bales per hour and the amount of lint left on the seed was reduced to a level that has been calculated to be about 6.6 percent. However, the rates attained by the rotabar are still far inferior to the 15 bales of hour that can be attained by the machine descendents of the Whitney saw gin. Despite these speed limitations, the roller gin is advantageous in that there are small amounts of short fiber with a concomitant increase in fiber strength and increased uniformity.

Each of the above mentioned gins have their advantages, but all also have drawbacks. The saw gin is faster but does not provide the longer desirable fibers. The roller gin produces the longer desirable fibers but is much slower. Accordingly, it is with the above considerations in mind the instant invention was developed.

BRIEF SUMMARY OF THE INVENTION

The present invention relates to an apparatus for cotton ginning, processes and methods associated therewith. The novel cotton gin technology of the present invention allows cotton fiber to be removed from cotton seed by utilizing a different mechanism than current saw ginning or roller ginning technology. The method of the present invention leads to increased yields while maintaining cotton fiber throughput leading to longer average and maximum fiber length from the same population of plants compared to the saw ginning technology. Less cotton is left on the seed, longer fibers are produced by the gin, and because the farmer is paid by the pound and quality of cotton, a direct influence on profit is made.

DETAILED DESCRIPTION OF THE INVENTION

The present invention relates to a cotton ginning apparatus, processes, and methods of using the cotton ginning apparatus that allows greater production of longer cotton fibers and improved production rates. Longer cotton fibers are desired because they allow the production of higher quality cotton goods.

The present invention also relates to an apparatus, to methods, and to processes that allow for good fiber length retention in the cotton ginning process. Fiber length retention is quantified by how well the long fibers are kept intact when the fibers are separated from the seed (i.e., with no apparent breakage). The present invention further relates to good fiber length retention in the cotton ginning process with good production rates. Generally, a production rate can be quantified by how fast the process can remove fiber from seed (i.e., speed). Other factors that that are important that may directly or indirectly affect production rates are the simplicity of the operation dealt with (e.g., the machine design) and how involved an operator must be to run this process and other factors. For example, in a factory that contains a plurality of the apparatuses of the instant invention, if an operator can operate and maintain a plurality of apparatuses rather than just being able to operate and maintain a single cotton ginning apparatus, the production and/or profit will increase.

In an embodiment, the present invention relates to an apparatus that is also know as the belt churka. Certain embodiments of the present invention will be described with reference to the figures. It should be understood that these figures are for illustrative purposes only and are not to limit the invention to only those embodiments. In this regard, those of skill in the art will recognize the generic characteristics of the invention and will recognize modifications or variations can be made to the invention while staying within the spirit and scope of the invention.

Figure 1:
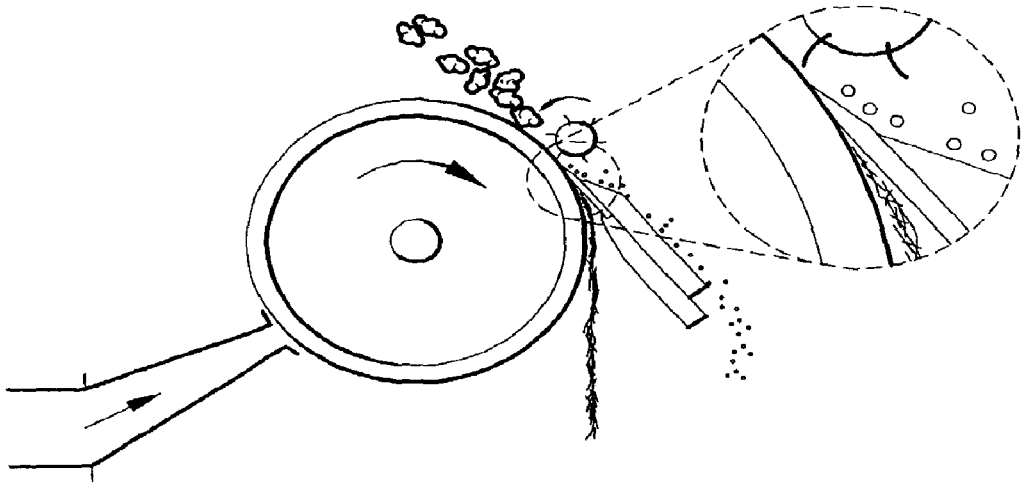
FIG. 1 shows a cross section of a comparative embodiment, which is a rotary knife gin.
Figure 2:
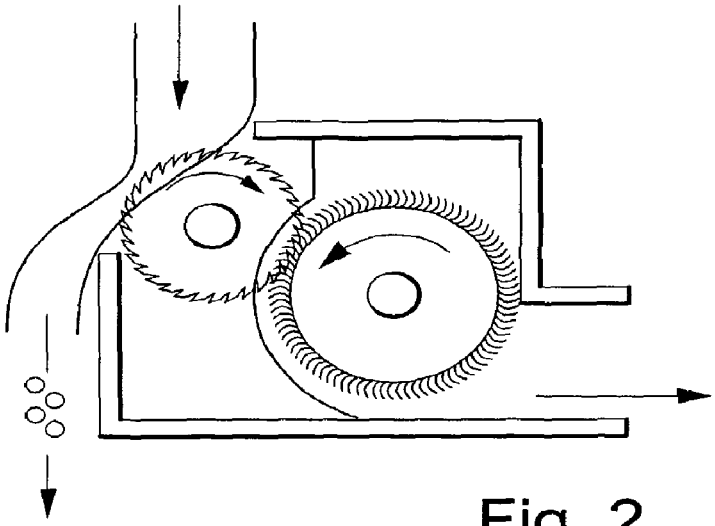
FIG. 2 shows a cross section of a comparative embodiment, which is a saw gin.
Figure 3:
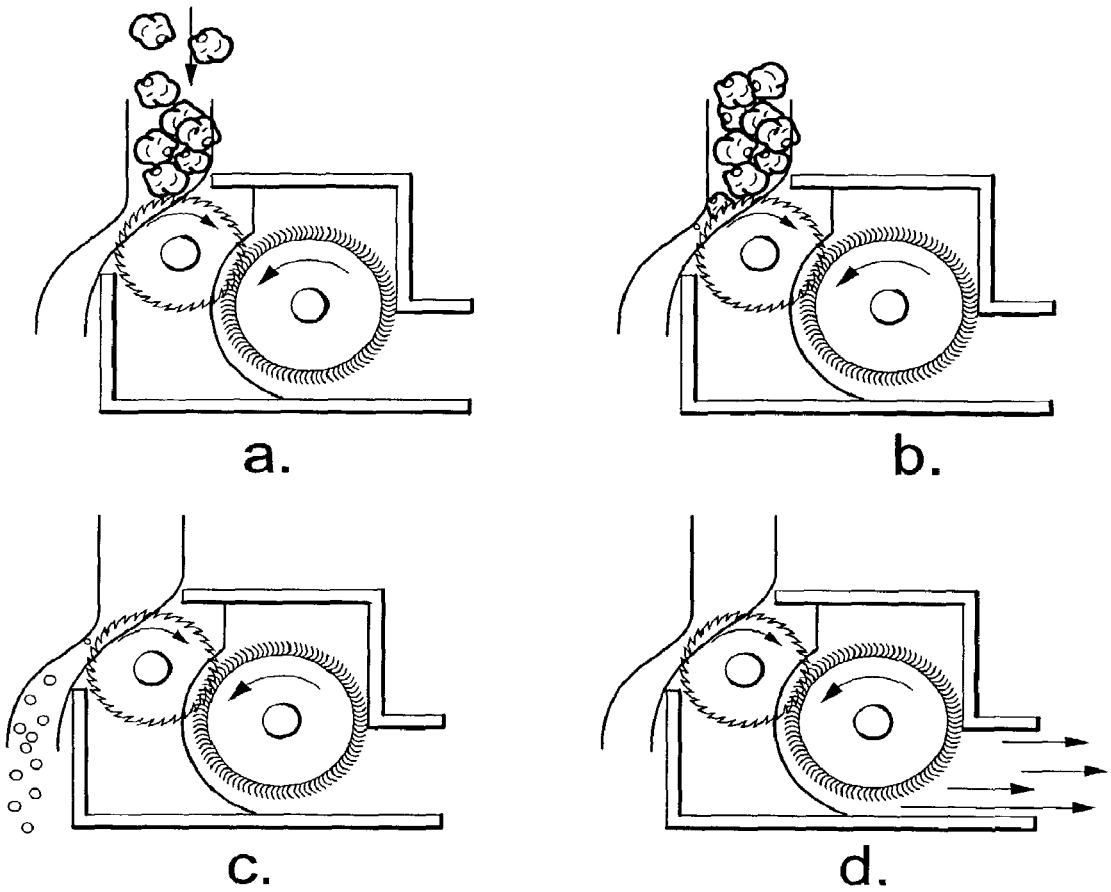
FIG. 3 shows a comparative ginning process by several depictions of cross sectional views of a saw gin.
Figure 4:
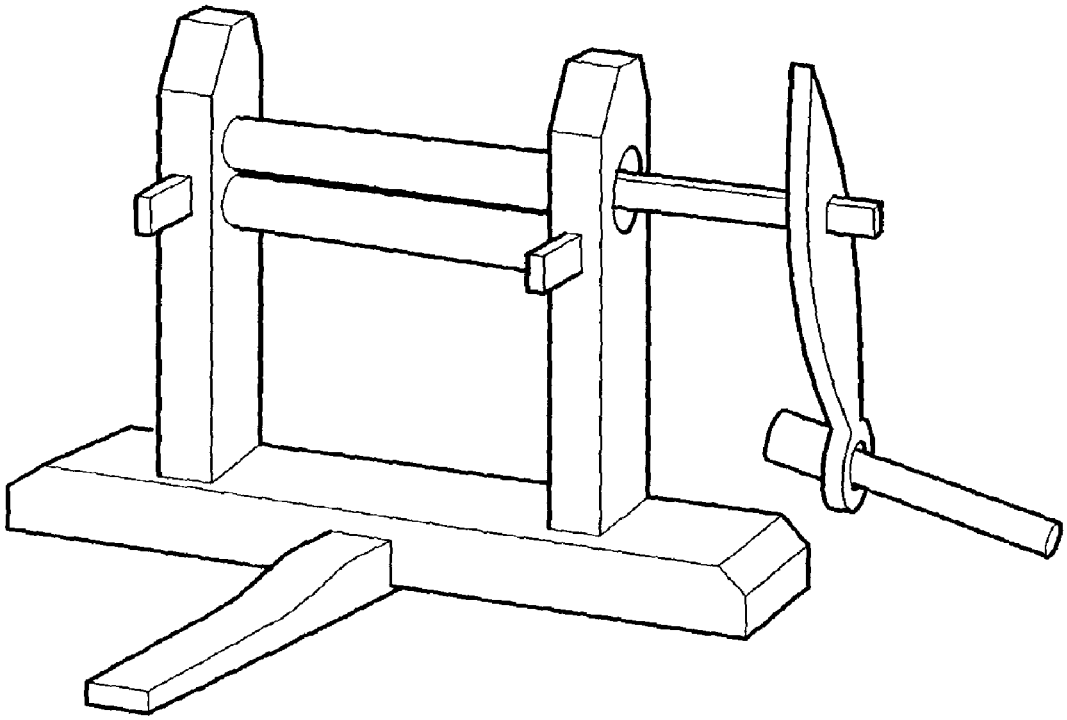
FIG. 4 shows a comparative embodiment, which is a churka gin processor.
Figure 5:
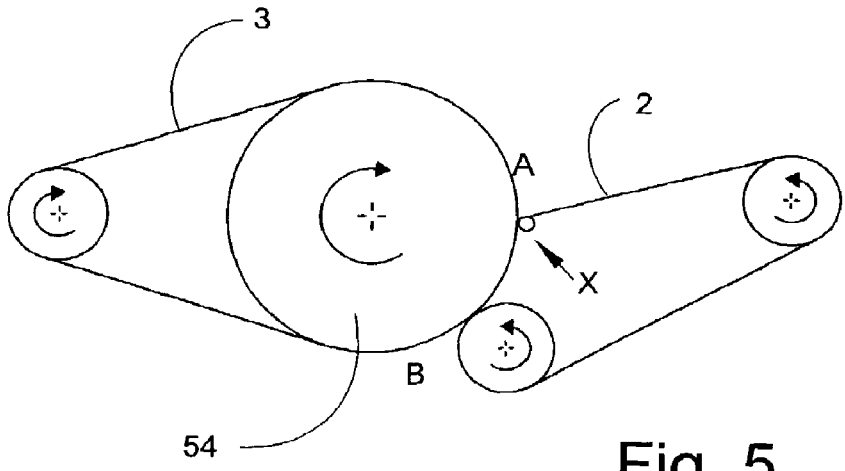
FIG. 5 shows a top down view of a belt churka, an embodiment of the present invention.

FIG. 5 shows one embodiment of the belt churka design of the present invention (i.e., a side view) that instead of applying the force at one particular point as is done in a churka gin, this embodiment instead applies a force along the entire fiber length. The entire fiber length is applied along the contour that appears as arc AB in FIG. 5. The use of a small diameter nip roller at point X allows the force to be spread along the entire fiber (at arc AB). As can be seen in the figure, the belts 2 and 3 are used to create a contoured surface that holds the entirety of the fiber (shown along arc length AB). The feed belt 2 carries the seed cotton to the nip point (labeled A). The main belt 3 turns the center wheel 54, which allows the creation of the contoured surface AB. The fiber is discharged from the bottom at B. The diameter of the small retaining bar X to some extent determines the efficacy of the ginning process. If the diameter of the retaining bar X is large in comparison to the cotton seeds' diameter then the belts may eat up the seeds as well as the fiber. If the retaining bar X is small relative to the seeds, the rate at which the belts can process the unprocessed seeds may decrease, leading to higher production costs. After ginning of the cotton seeds from the cotton fiber, the cotton fiber is discharged at B.

Although the embodiment of the belt churka design as shown in FIG. 5 is ideally suited to a selection matrix and design constraints, it should be recognized that other designs employing the belt churka idea are contemplated and within the scope of the invention. It has been found that the belt churka technology gives the best results with regards to fiber length retention of any of the plurality of designs that were tested. Moreover, it has been found that the belt churka design production rates can be increased by increasing the number of belt churkas that are combined per machine (see FIG. 6, which will be described in more detail below). The churka, although elegantly simple in design, most effectively retains longer fibers during separation of the fiber from the seed than any of the other designs tested. Accordingly, the belt churka technology gives very good length retention, is very feasible, and is relatively un-complex in both parts and materials.

Figure 6:
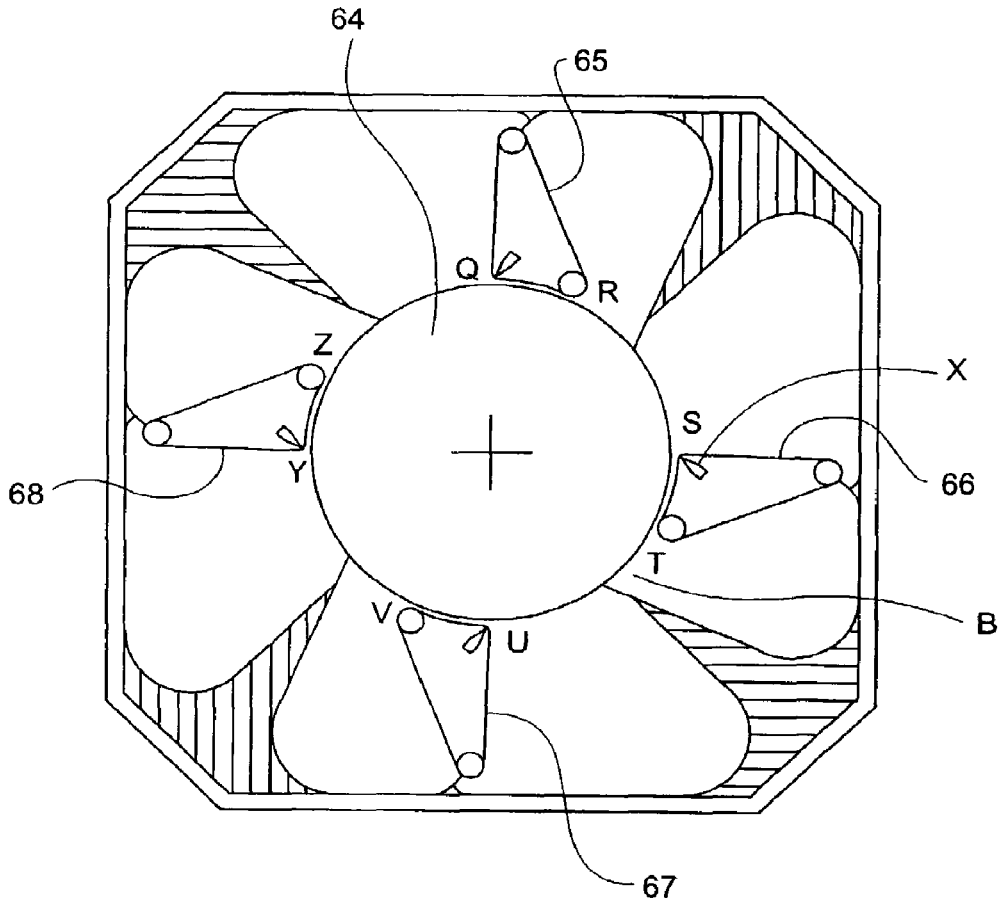
FIG. 6 shows a top down view another embodiment of the present invention, a machine that has a plurality of belt churkas.

The embodiment of FIG. 6 shows a vertically aligned design (for the purposes of this invention, 'vertically aligned' refers to the axis of the main drum 64), with four separate points of interaction in the ginning process. These four points are at Q, S, U, and Y and they are the start points of contours at arc lengths QR, ST, UV, and YZ on belts 65, 66, 67, and 68, respectively, all of which perform a similar function to the contoured surface at AB in FIG. 5. The embodiment of FIG. 6 offers advantages in that there are a plurality of belt churka designs that allow for a greater production rate for a single machine, allow energy conservation in that fewer motors can be used, and conserve space so that production can be increased without the concomitant increase in the amount of space that is required (e.g., a single motor can be used to drive any of a number of belts). This embodiment also allows installation flexibility, has relatively easy preventative maintenance access, and also eases production because of the relative flow of raw materials.

In the present invention, any of a plurality of types of motors can be used such as electric motors or gas powered motors. It is also contemplated and therefore within the scope of the invention that other sources of power can be used to power the motor including but not limited to battery powered motors, hydrogen powered motors, solar powered motors, wind powered mowers, or any other alternative form of energy that can be used to power motors.

In a variation of this embodiment, the unprocessed cotton (containing both cotton seed and fiber) will be fed into the belt churka by any of a number of feed technologies. For example, the machine can use the feed technologies that are known in existing cotton gins that can be incorporated into the instant embodiment with no or only minor modifications. As is shown in FIG. 6, there are four feed areas (or four seed cotton compartments) with the one of the feed areas being labeled S (it should be noted that only one of the four seed cotton compartments is labeled). In this embodiment, the main rotating drum 64, creates nip points with the small retaining bars at the point labeled X. As was apparent in FIG. 5 and is again apparent in FIG. 6, the contoured ginning interactions at arc lengths QR, ST, UV, and YZ are long, which creates a normal force along the length of the fiber allowing for the production of longer cotton fibers. The normal force at arc lengths QR, ST, UV, and YZ pulls the fiber away from the cotton seed, which is restrained by the small retaining bar X. Although the retaining bar is shown as shape that comes to a point at one side, it should be understood that the retaining bar can be any of a plurality of shapes, sizes, and materials or any combination thereof. For example, the retaining bar may be circular in a cross sectional area (i.e., cylindrical when considered in three dimensions), or square in cross sectional area, or any other shape that adequately performs the ginning process. Any of these plurality of shapes, sizes, and materials will be effective to gin the unprocessed cotton into the collection compartment B. The unprocessed cotton and the ginned cotton may be moved from compartment to compartment or from compartment to the nip point or anywhere else in the machine by any of a plurality of mechanisms, including but not limited to compressed air, vacuum suction, and/or mechanical manipulation. In an embodiment, the direction of the air jets (or the source of the vacuum or the direction of the mechanical manipulation) as well as the seed cotton compartment shape and the surface frictional properties will aid in the movement of the seed cotton to the nip points X and then along the ginning interaction arcs (e.g., ST) with the main rotating drum 64.

In a variation of this embodiment, the ginned cotton seeds may be collected at the bottom of the seed cotton compartment. The cotton may be easily separated in an air flow due to inherent differing air drag properties. The seeds without cotton will tend to fall to the bottom of the compartment while the seeds with cotton will be jostled against and caught in the upward air flow due to their different air drag properties. The upward airflow pressures inside the seed cotton compartment may be slightly less than the airflow pressure in the four compartments to allow for positive cotton feed into the compartments, C. It should be understood that the airflow may be used to aid in feeding cotton to the contour arc or alternatively, may be used to separate the cotton seeds from the cotton fibers after the ginning occurs. In any event, in this variation, the airflow aids the ginning of the unprocessed cotton.

The vertically aligned belt churka shown in FIG. 6 can gin four times as much cotton as a horizontally aligned belt churka due to the four fold increase in belts per main drum 64. Although the vertically aligned belt churka is shown with four belt churkas, it should be understood that the design can contain any number of belt churkas. The number of belts may be dependent on the relative amounts of the cotton fibers that are to be produced. In an embodiment, the number of ginning interactions and the final configurations may be engineered per customer need, cost, and/or price. Alternatively, the size of the machine and the number of belts may be based on economics and the desired or needed output.

Figure 6A:
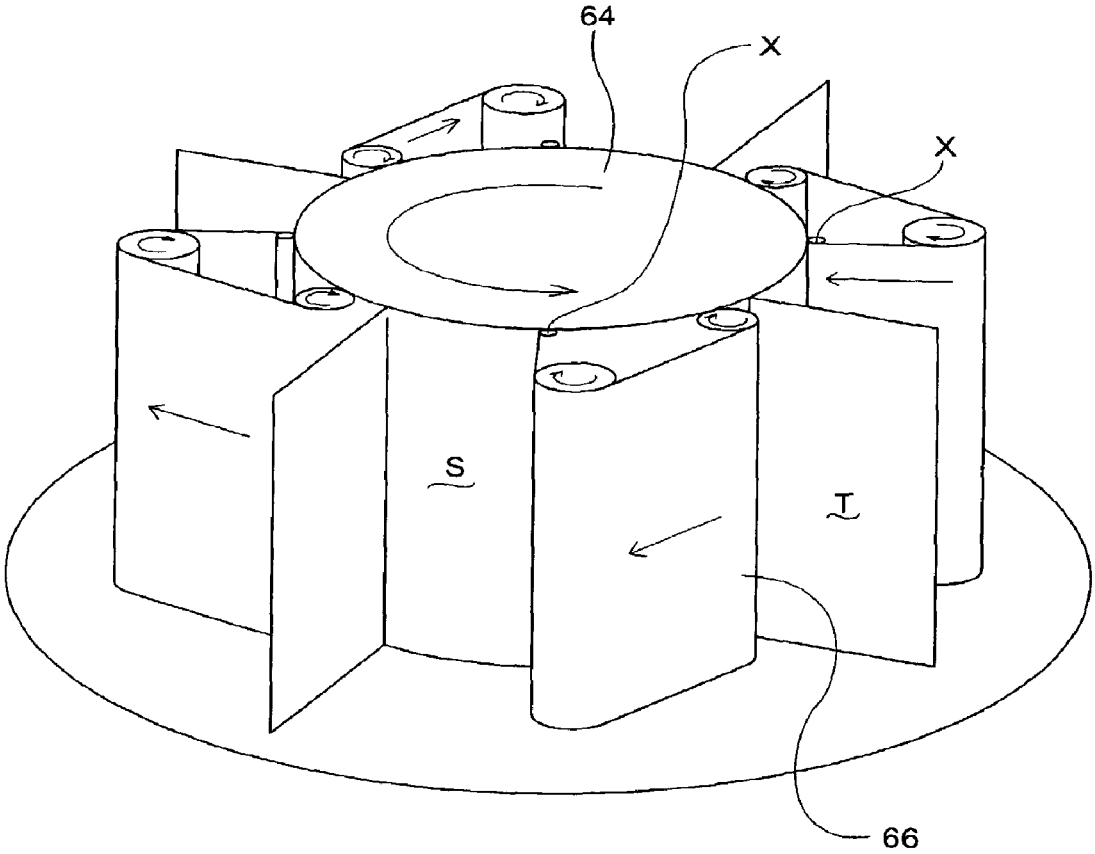
FIG. 6*a* shows a perspective view of an embodiment of the present invention, a machine that has a plurality of belt churkas.

FIG. 6A shows a perspective view of the same configuration of the vertically aligned belt churka as is shown in FIG. 6.

EXAMPLES

Figure 7:
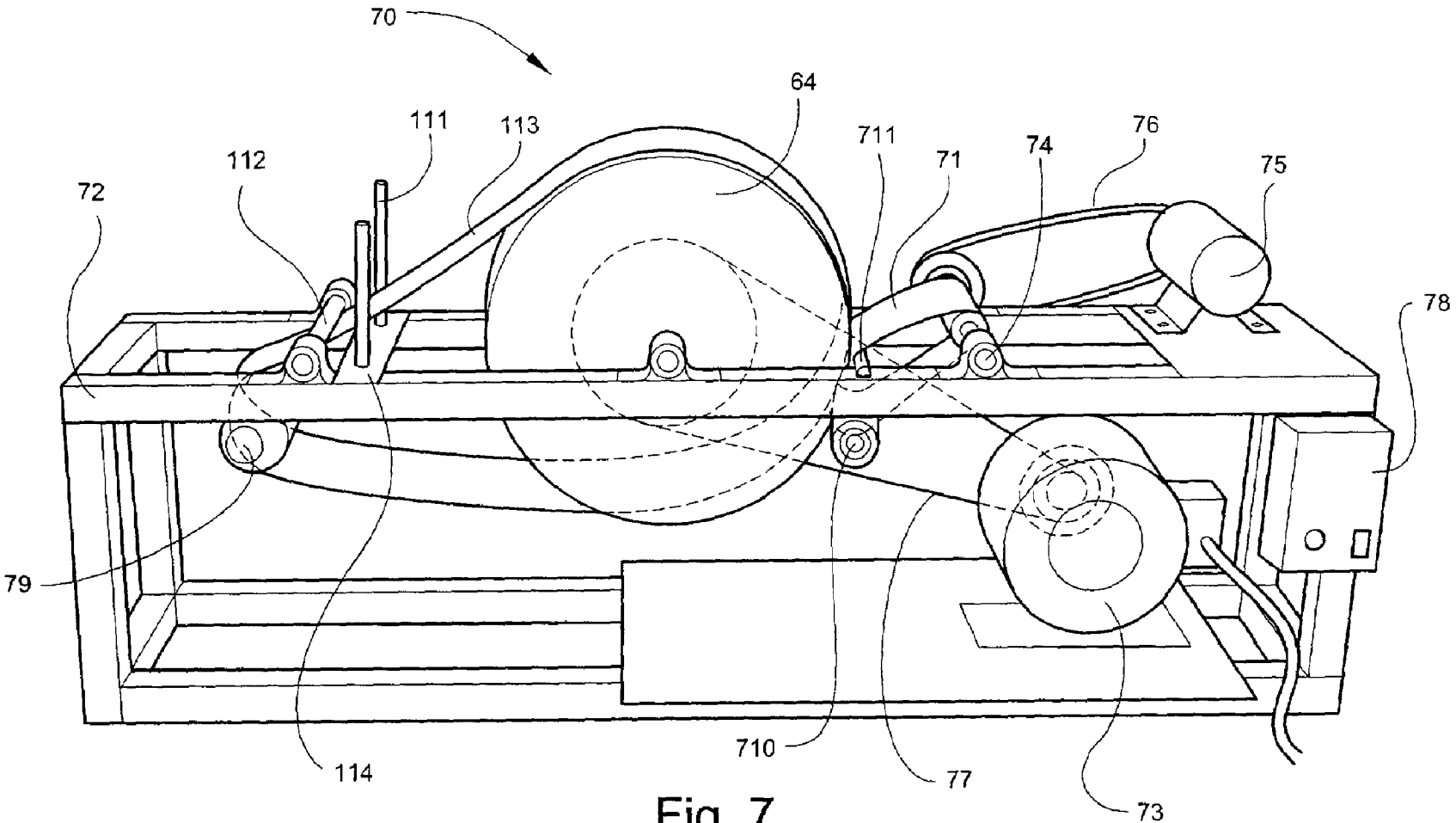
FIG. 7 shows a perspective view of one depiction of an belt churka embodiment.

FIG. 7 shows a belt churka prototype that was built. In this embodiment, the supporting frame 72 is constructed of extruded aluminum with channels in a square cross section allowing for attachment of motors 73, 75, drums, rollers 74, belt guide systems 111, 112, belts 71, 76, 77, 113, and retaining bar 711. It should be understood that other supporting frames are contemplated and within the scope of the invention. For example, the supporting frame may be built of wood, steel, plastic, hard rubber, other metals, or any of a plurality of other materials.

Figure 8:
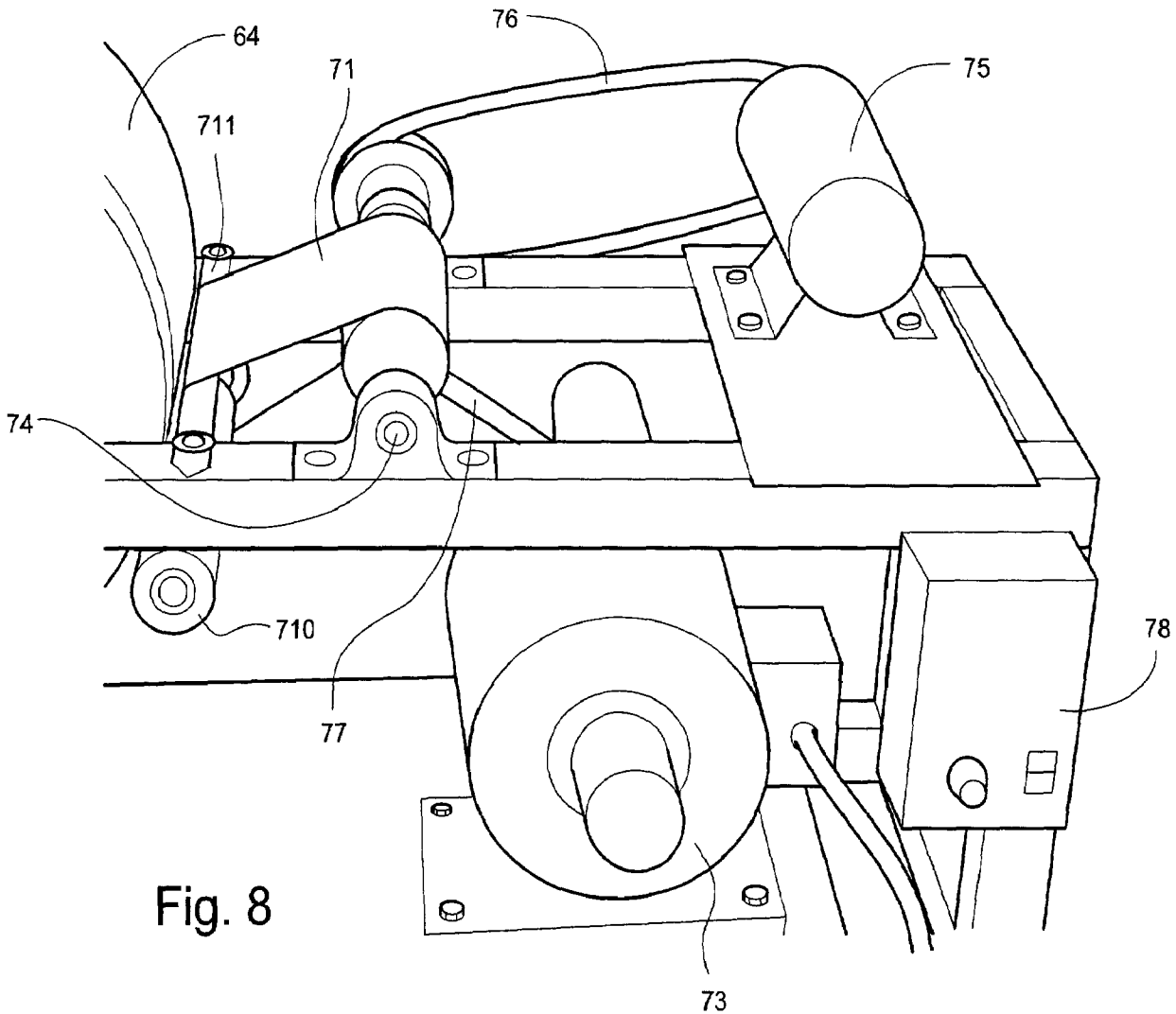
FIG. 8 shows a perspective view of one part of an belt churka embodiment.

FIG. 7 shows an embodiment with two motors 73, 75. However, it should be understood that a single motor could be used that can drive several different belts. Alternatively, more than two motors may be used. In the shown embodiment, two motors 73, 75 were used to drive two different diameters of the drum/roller. In this particular embodiment, the motor 75 driving the smaller diameter roller 74 using belt 76 (as better shown in FIG. 8) is a PMDC (Permanent Magnet DC) electric motor rated at ¼ hp and 3450 rpm with variable speed control. The motor 75 and variable speed control 78 were ordered from Electrical Equipment Company (Richmond, Va.) who gets their motors from Baldor Motors and Drives (Toledo, Ohio). The motor 73 driving the larger diameter drum 64 (as better seen in FIG. 9) is a ½ hp DC motor obtained from a woodworking lathe. The variable speed control 78 (as better seen in FIG. 8) allows the operator to set the surface speeds of the belts 71, 113 so that they are equal. If the surface speeds of the belt 71 and belt 113 are not equal, the normal force on the cotton fibers are not uniform and breakage of the cotton fibers may occur.

Figure 9:
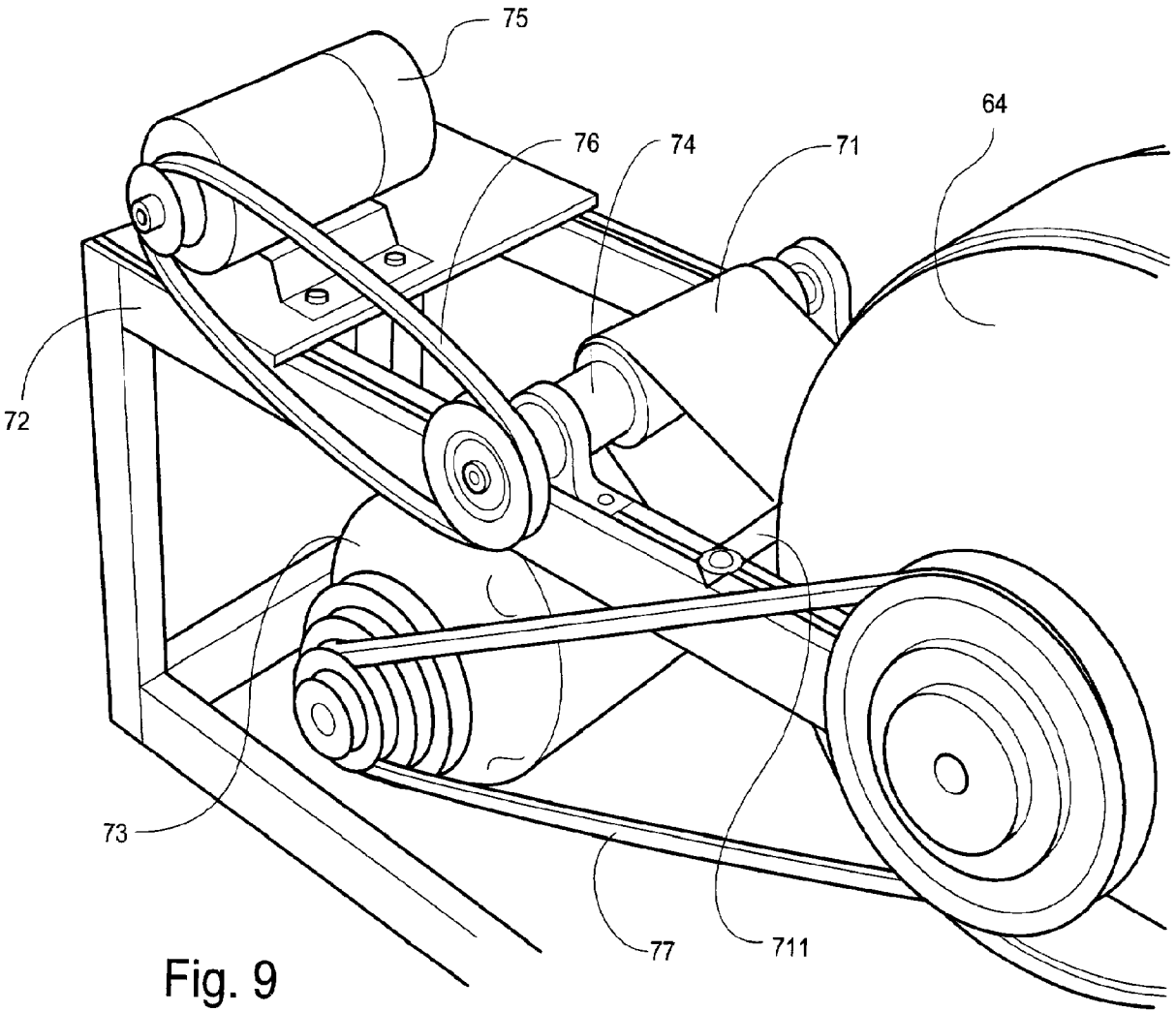
FIG. 9 shows a perspective view of one part of an belt churka embodiment.

As shown in the embodiment of FIG. 7, the motors 73, 75 were mounted in optimal locations on the frame using the space available and attached to the appropriate pulleys via 4 L v-belts 76, 77 (as also shown in FIG. 9—the v-belts were 29" and 58" in length). The mounting of the motors 73, 75 may be dependent on the space layout of the machine 70 and the factory or place where the machine 70 resides. In the embodiment shown, the variable speed control 78 was mounted on the side of the frame although it is contemplated that other locations for the variable speed 78 control are possible.

Careful consideration should be made in selecting drums and rollers, as they are important to the successful operation of the prototype and other belt churka devices. Driven by the electric motors, the drums and rollers (e.g., 74 and 64 in FIG. 7) must rotate quickly to perform their intended function. The ginning belt 113 in the prototype was constructed of leather. However, other materials may be used such as plastics or various rubbers or some other synthetic or natural material. As shown, the belt 113 revolves around the larger diameter drum 64, which in the embodiment shown measures 13.5" in diameter, and a smaller roller 79, that acts as a tension device. In a variation of this embodiment, the belt may be kept in place on the drum and roller through the use of guide posts 111 and/or other tension devices. A non-woven belt 71 with a rubber or plastic (or alternatively, leather or some other appropriate material) backing may revolve around the smaller diameter driven roller 74. The driven roller 74 may be bowed to counteract any migrating or jumping of this belt 71 off of the retaining bar, and there may optionally be another roller 710 mounted on the underside of the top of the prototype frame 72, contacting the larger diameter drum 64 lower on the lower drum's surface. This configuration creates a contact surface (for example, AB as shown in FIG. 5) that is longer than the longest cotton fiber, between the two ginning belts 71, 113 which allows for a normal force to be applied along the length of the cotton fiber. This lay-out allows for one to obtain longer cotton fibers than other methods.

Figure 10:
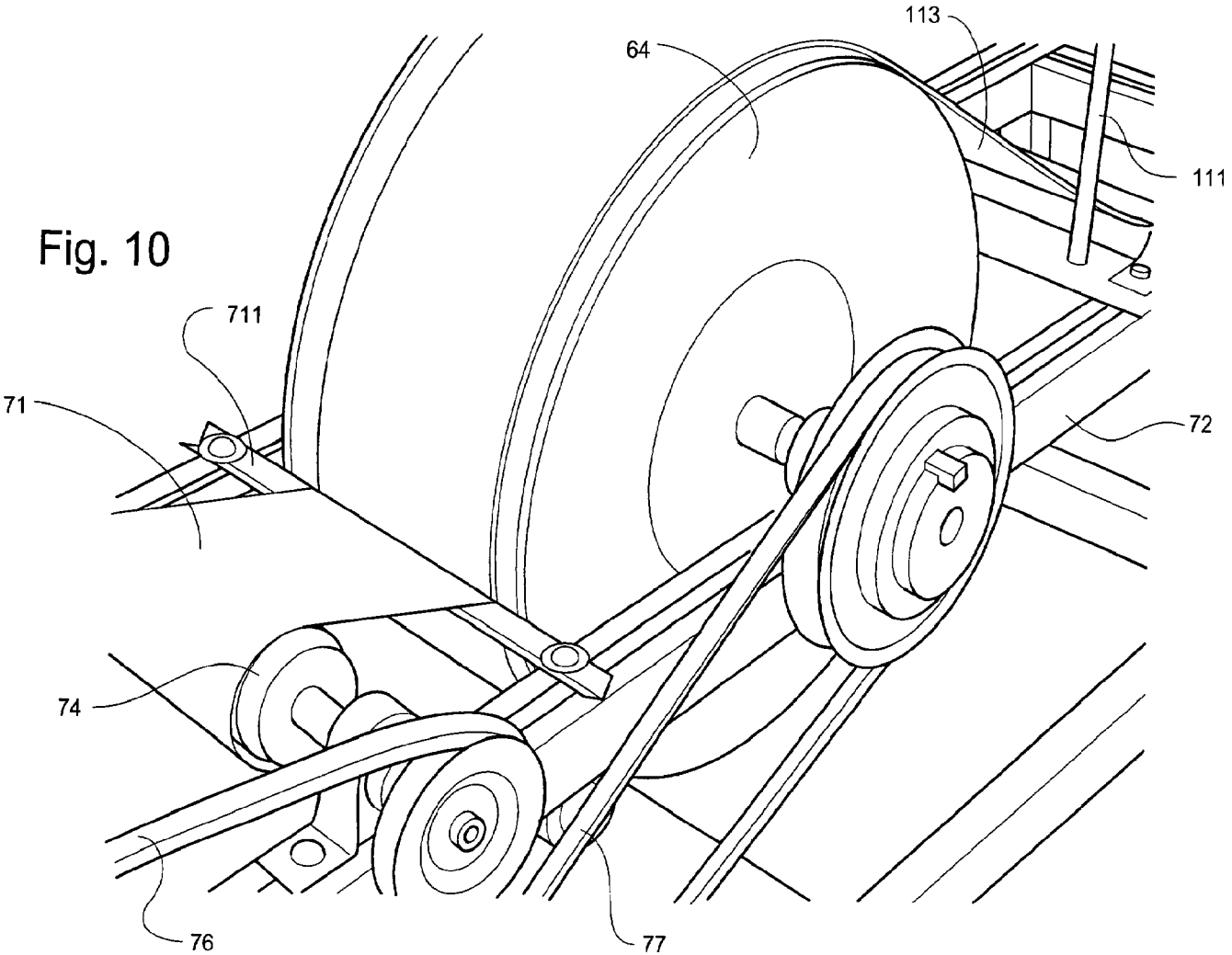
FIG. 10 shows a perspective view of one part of an belt churka embodiment.

As shown in FIG. 10, a retaining bar 711 may be used. In the embodiment where a retaining bar 711 is used, the retaining bar may be present as a 90° v-shaped piece of metal mounted to the aluminum frame 72 with the v shape oriented "up". This 90° v-shaped piece of metal was found to be the correct length e.g., 11" and was mounted to the frame 72. The rigidity requirements were met by the retaining bar 711, as well as the small radius of curvature found on the edge. This configuration was easily adjustable and did not move out of place due to the forces of ginning seed cotton. In the orientation as shown, the edge of the retaining bar pushes and/or holds the nonwoven ginning belt 71 into contact with the leather ginning belt 113. At the point where the ginning belt contacts the leather ginning belt (for example, see X in FIG. 5), there is an interaction between the ginning belts 71, 113 and the cotton fiber which when unprocessed cotton reaches the point of contact, the fibers pass the retaining bar 711 and are passed into the arc region (for example, the arc region AB as shown in FIG. 5) while the cotton seed is halted due to the seeds inability to fit between the ginning belt 71 and the leather ginning belt 113. Accordingly, in this way, the cotton seed is separated from the cotton fiber.

Figure 11:
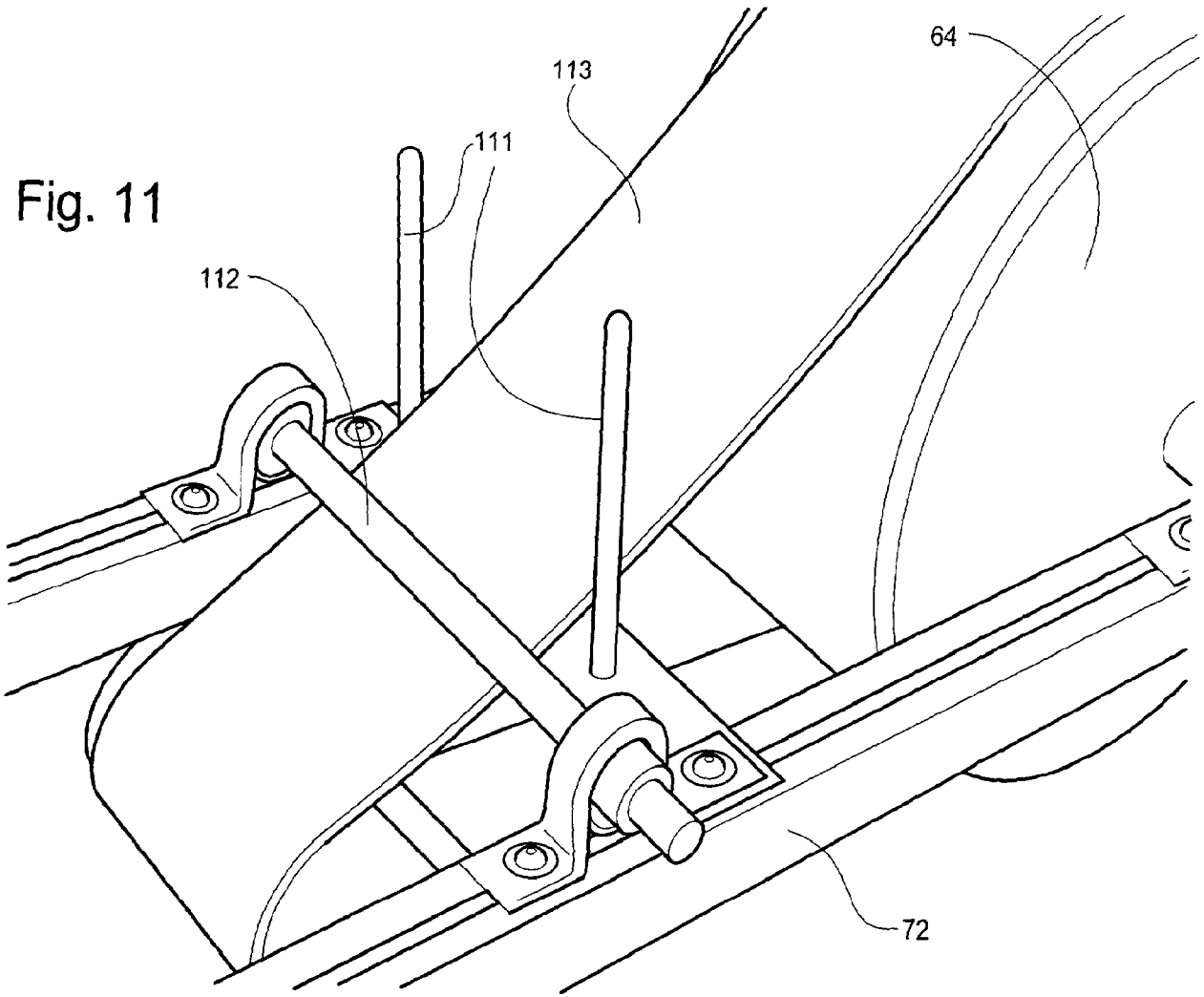
FIG. 11 shows a perspective view of one part of an belt churka embodiment.

As shown in FIG. 11, the belt guide system 111, 112 on the larger diameter drum's leather belt 113 can be constructed of metal posts 111 or of some other suitable material such as hard plastic and the like. The size will depend on the particular configuration use. In the embodiment shown, the metal posts 111 are approximately 5½" long mounted on a metal support 114 that is about ⅛" thick and 11" long (although other sizes are contemplated and within the scope of the invention). In the embodiment shown, there may be an optional roller 112 that is approximately ⅝" diameter in size that is mounted on the prototype frame 72 that is used to apply downward force to keep the belt 113 from trailing up the sides of either post 111. This configuration (as shown) will help prevent side to side belt 113 migration. It is contemplated and therefore within the scope of the invention that other configurations to prevent side to side belt migration can be used.

Electric tape or some other type of tape can optionally be used to bow a roller and allow the guidance of belts on rollers (for example, the nonwoven belt 71 on a smaller diameter roller 74). The presence of the tape will allow an appropriate tension to be applied to the belt 71 in various locations along its width to prevent belt migration. When the appropriate tension is achieved, the belts tend to stay in place and do not jump off the rollers. As an alternative to using tape, the rollers may be machined in such a way as to preclude the need for tape. As an example, the rollers may be machined so as to have thinner diameter on the part of the roller that contacts the belt and fatter diameters on the part of the roller that is outside of the belt (and does not contact the belt—similar to the roller design that is shown for roller 112 in FIG. 7).

In an embodiment, the ginning belts 71, 113 are kept in place when rotating at high speeds by mounting the leather belt between two guide bars 111 and a roller 112 as shown in FIG. 11. The guide bars 111 help prevent side to side belt migrations while the roller 112 applies downward force to keep the leather belt 113 from trailing up either of the guide bars 111. In an embodiment, the other smaller diameter roller 79 can be bowed with electric tape to an extent that it applies tension to the nonwoven belt in various locations along its width until a force balance is achieved allowing the belt to remain in place. It should be recognized that any of the plurality of rollers that are discussed may be bowed so as to provide the appropriate tension requisite for proper ginning to occur.

Pulleys are also optionally used in an embodiment of the present invention. Pulleys are optionally used to operate two or more belts at the same surface speed. The ratio of the larger diameter drum 64 plus leather belt 113 to the smaller diameter roller 74 plus nonwoven belt 71 will likely dictate the size of pulleys needed. In a variation of this embodiment, it was determined that the larger diameter drum 64 would need a 7.33" pitch diameter to a 1" pitch diameter of the smaller roller 74 to obtain equal surface speeds. If a single motor is used, it must have sufficient horsepower so as to be able to drive the apparatus at high speeds. Alternatively, two motors can be used (as shown in the embodiment represented by FIG. 7). If two motors are used, one of the motors 73 turns the larger diameter drum 64 at its full capacity and a variable speed PMDC motor 75 can be activated by the operator and dialed to the correct surface speed using a variable speed control 78 for the smaller diameter roller turning the nonwoven belt 71. Pulleys can be obtained from standard commercial sources, for example, from Grainger (Lake Forest, Ill.). In a variation of the embodiment, variable pitch pulleys with the correct ranges of pitches can be used for example to address the needs of both a 1" and a 7.33" pitch diameter size.

Generally, it is desired to have all the parts well machined and all other parts of high quality. For example, the belts should be of uniform thickness and the drums/rollers should be uniformly round, so as to prevent causing too much friction, which may ultimately bog down the belt churka.

A failure to correctly machine parts or to use high quality parts potentially might lead to too much or to too little tension on the ginning and drive belts. If too little tension were applied to the drive belts, then the drive belts would have insufficient friction to turn the drum/roller (with the horsepower supplied from the motor). Moreover, if too little tension were applied to the ginning belts, then the belts tend to fly off track. Likewise, too much tension on either the drive belts or ginning belts led to problems such as overloading the motors, which in turn prevented the belt churka from functioning. To properly adjust the tensions, trial and error proved to give the most fruitful results. The tensions can be adjusted in any of a number of ways. Among the ways that the tension can be adjusted is by one or more of adjusting the relative positions of the rollers, adding or removing electrical tape or some other material to the rollers that make them bigger or smaller in diameter, adjusting belt sizes, and/or by other means.

Generally, the motor size is chosen so as to appropriately be able to drive the various rollers and belts. One desires a motor that has sufficient horsepower so that it will not get bogged down by the tension that is applied by the belts on the rollers. However, the motor should not be so large in horsepower as to possibly damage any belt on the rollers (for example by continuing to drive the rollers even if the tension is too tight). Other factors can also be considered when selecting a motor such as the amount of energy that the motor requires to operate, or the number of rollers and belts the motor is to drive, and/or any other factors. In one embodiment, the horsepower of the motor dictated that a ½ hp motor be used, wherein the motor was used to drive several different rollers and belts. Alternatively, in an embodiment, two ¼ hp motors were used. One motor was used to turn the smaller diameter roller and belt while the other was used to turn the larger diameter drum (as shown in FIG. 7). The two motor configuration was found to operate the design to sufficiently high speeds and when tested, ginned cotton well.

In the tests, technical analyses of the belt churka design was performed to analyze how well the machine worked to generate the desired product (i.e., long cotton fibers without seeds). A species of seed cotton was appropriately chosen to have the desired characteristics (i.e., cotton that had the potential to generate long cotton fibers). 30-40% of the fiber was removed from the seed cotton and the fibers were teased apart, by hand, while being careful not to tear any fibers or detach them from the seed. The belt churka was started and a sufficient amount of time was allowed to pass for the rotating drums to reach their full rotational speed. The prepared seed cotton was then fed onto the feed belt (as shown for example, by 2 in FIG. 5) at which point the cotton fiber was taken into the nip point (labeled A in FIG. 5) while the seed was retained by the small radius of curvature retaining bar (labeled X in the Figure). The normal force applied by the belts along the contour length AB of the fibers separated the fibers from the seed, ejecting the seed and throwing the cotton into a collection bin at B.

Figure 12:
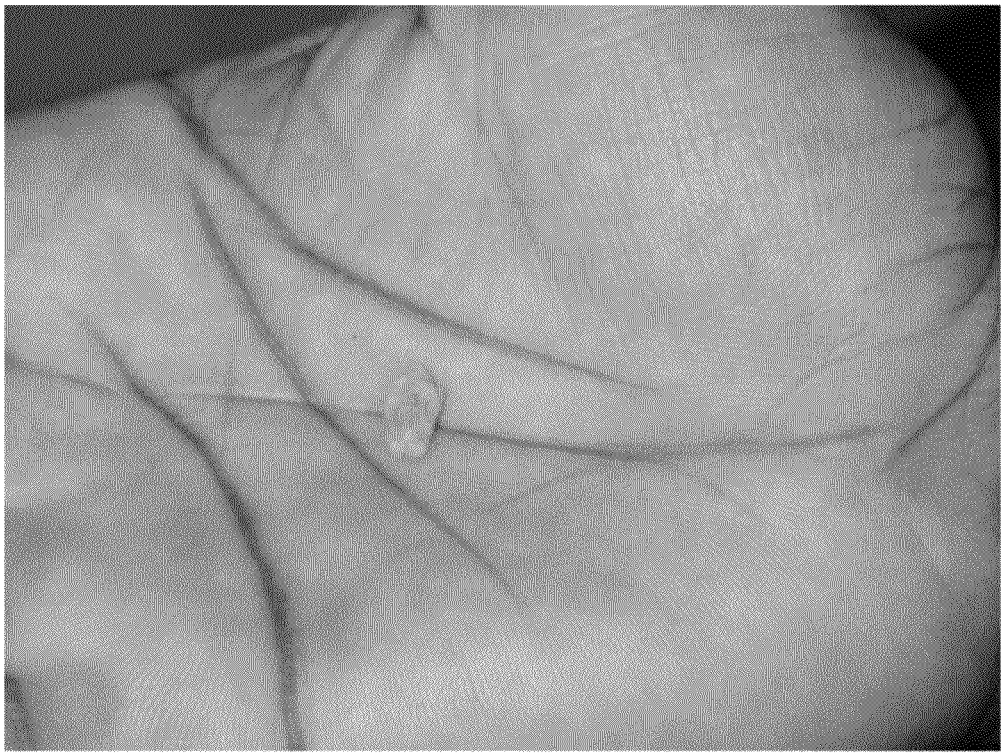
FIG. 12 shows a photograph of cotton seed after separation using a belt churka embodiment.
Figure 13:
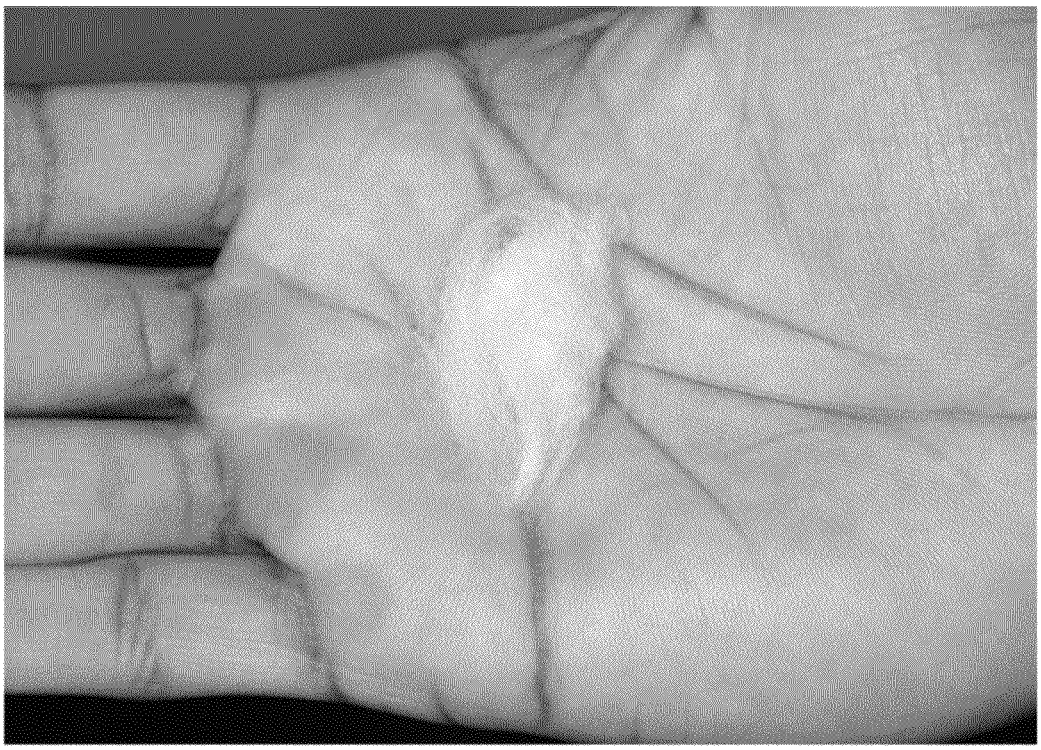
FIG. 13 shows a photograph of the cotton fibers after separation using a belt churka embodiment.

FIGS. 12 and 13 show the results of the test. Nearly 100% of the fibers were removed from the seed. No pieces of the seed coat were removed in the process and the seed remained intact. This indicates that the belt churka worked exactly as designed. Only a few seeds had fibers remaining on the seed, and the fibers on the seed measured approximately 1-2 mm in length. All remaining fuzz left on the seed was less than 1 mm in length.

FIG. 13 shows a typical picture of a cotton fibers. It should be noted that in this picture, no seed remained attached to the cotton and no pieces of the seed coat were found in the fibers. Moreover, by visual inspection, no evidence of fiber shredding could be found. Thus, the embodiment of the present invention appeared to extract the fibers from the seed by exerting a force along the length of the fibers which removed the fibers from the seed without apparent damage to the fibers with no contamination from seeds or seed parts. Moreover, no discoloring of the cotton fibers was observable. Furthermore, there were no unusual odors detected immediately after the ginning process in the belt churka. Had the ginning process not been successful, one might have expected an unusual odor from possible charring or friction from the belts and/or from the cotton.

Other features of the invention include a design to reduce dust. An industrial design analysis including an environmental analysis and an ergonomics analysis was carried out on the final design. Generally, in cotton ginning the dust tends not to be medically harmful, but rather tends to be more of a nuisance. In order to comply with EPA emissions controls for cotton gins using controls such as cyclones and filters, an estimation of the dust generated was calculated. EPA tolerances for cotton gins are given in the below table 1.

TABLE 1

| Particulate Emissions for a Cotton Gin With Controls | |
|---|---|
| 1. unloading fan: | 0.32 lb/bale |
| 2. no. 1 dryer and cleaner: | 0.18 lb/bale |
| 3. no. 2 dryer and cleaner: | 0.10 lb/bale |
| 4. trash fan: | 0.04 lb/bale |
| 5. overflow fan: | 0.08 lb/bale |
| 6. no. 1 lint cleaner condenser: | 0.81 lb/bale |
| 7. no. 2 lint cleaner condenser: | 0.15 lb/bale |
| 8. mote fan: | 0.20 lb/bale |
| 9. battery condenser: | 0.19 lb/bale |
| 10. master trash fan | 0.17 lb/bale |
| TOTAL | 2.24 lb/bale |

In order to reduce dust, one embodiment of the present invention uses a totally enclosed system, which leads to a safer and more easily controlled system. The controls in this enclosed system are easily accessible and are outside of the enclosed system. In an embodiment, the controls for the machine will all be at easily reachable heights with no obstructions.

In an embodiment, the belt churka concept is designed to have optimal features for ergonomics, aesthetics, function, problems of uniformity, and problems of tolerances.

Accordingly, in an embodiment of the present invention, the machine is designed so that an operator must simply turn the power switch on to start the ginning process. This is an operator friendly method of initiating the belt churka cotton ginning method. In a variation of this embodiment, the prototype is built with operator safeguards such as an emergency shutoff or shields to protect someone from getting snagged by the moving parts. The pinch points between the ginning belts and drums, the two ginning belts, and the pulleys and v-belts can optionally be protected. If these safeguards are not used, the operator may need to exercise caution and a keen sense of where each of his/her body parts are in relation to the machine while running the machine before and during start-up. In an embodiment, the belt churka may also be designed so as to eliminate any potential electrical problems such as ground plugs and safety shut off switches.

In an embodiment of the present invention, the aesthetics of the design were also considered. The quality of the materials used and the elegant simplicity of the machine were all considerations that were taken into account in the production of the machine. Thus, the design of the machine suggests strength, speed, and quality.

The belt churka was designed successfully to gin seed cotton rapidly while retaining original fiber length. These results were achieved by the careful design of the concept. The motors are designed to rotate at any of a plurality of speeds, but in one embodiment, the machine functions as intended when the rollers rotate at about 1700 rpm. When this rotation rate is attained, the seed cotton is ginned well while attaining the desired cotton fiber length. Moreover, when the tensions are adjusted properly, belt displacement is minimal at this rotation rate. At higher speeds, if the parts are not well machined, there is the possibility of balance problems. For example, if there are unbalanced drums, the machine may experience excess vibration and noise, which would be an undesirable attribute to customers. In other words, because of the relatively high rotational velocities and the relatively close proximity of parts, the materials used to build a faster and larger industrial belt churka should be precisely machined to obtain tight tolerances and smooth operation.

When the retaining bar 711 is designed to be as close to the large rotating drum/ginning belt 64, 113 as possible without generating too much friction, the belt churka performed exactly as desired. However, if the retaining bar 711 is too far from the surface of the ginning belt 113 on the large diameter drum 64, seeds were likely to pass through the nip points, and the cotton was not adequately ginned. The ginning belts should also be of uniform thickness and length to allow a constant and predictable tolerance between the ginning belts and retaining bar.

The use of the belt churka should produce a cotton product that is much higher than that of the more commonly used saw ginning machines, and that should easily meet or exceed ASTM standards. The belt churka is able to successfully remove almost 100% of the remaining fiber from cotton seed with minimal breakage (see FIGS. 12 and 13, for example), meaning there is little contamination in the cotton fibers.

Accordingly, in an embodiment, the present invention is directed to an apparatus, methods, and processes for processing unprocessed cotton such that the cotton seeds are separated from the cotton fibers (also known as "cotton ginning"). In a variation of the embodiment, the present invention relates to an apparatus, processes, and methods that allow for the production of longer cotton fibers and improved production rates.

Moreover, in an embodiment, the present invention relates to an apparatus for cotton ginning comprising: a belt; and one or more rollers; wherein the belt and the one or more rollers are operatively connected and the belt is configured to have a contoured surface such that unprocessed cotton is processed so that cotton seeds are separated from cotton fiber; and the cotton fiber is held by the contoured surface. In a variation of this embodiment, the apparatus comprises a plurality of rollers and a plurality of belts. For example, the apparatus may comprise at least four rollers and four belts and at least two of the belts are configured so they create the contoured surface. In a further variation, the apparatus may further comprise a nip roller. The apparatus may comprise a plurality of belts and at least one of the plurality of belts is a feed belt.

The apparatus may have a plurality of motors or may have at least one motor. The plurality of motors or the at least one of the at least one motor is used to drive the feed belt.

In an embodiment, the nip roller in the apparatus may be used to effectively separate the cotton seeds from the cotton fiber so that close to 100% of the fiber is removed from the cotton seeds. In an embodiment, the apparatus may further comprise at least one of an air compressor, a means of generating a vacuum, or a mechanical feeder. The air compressor, the means of generating a vacuum, or the mechanical feeder are optionally configured to feed the unprocessed cotton to a feed belt.

In another embodiment, the present invention relates to a method of cotton ginning comprising: feeding unprocessed cotton into an apparatus that contains at least two belts wherein two of the at least two belts are operatively connected to each other so as to generate an arced contour and wherein the arced contour applies a normal force to cotton fibers allowing separation of the cotton fibers from cotton seeds. In a variation of this method, the at least two belts undergo rotation by at least two rollers that are operatively connected to the at least two belts. In a further variation, the at least two rollers undergo rotation by one or more motor(s) that is/are operatively connected to the at least two rollers. Optionally, the at least two rollers rotate at essentially the same rotational rate. The rotational rate in one embodiment is approximately 1700 revolutions per minute.

In a further variation of the method, an apparatus may be used that further comprises a nip roller. The nip roller may be of a size that allows passage of cotton fibers but not of cotton seeds into the arced contour.

In a variation of the method, about 90 percent or more of the cotton fibers are separated from the cotton seeds. In another variation about 50 percent or more of the cotton fibers are $^{35}/_{32}$ inches or longer.

A plurality of features of the belt churka have been disclosed above. It should be understood that any one or more of this plurality of features can be combined with any other one or more plurality of features to give an embodiment which is contemplated and therefore within the scope of the present invention. Modifications and variations can be made to the belt churka apparatus, methods and processes of the present invention without departing from the spirit and scope of the invention. Thus, the present invention is not to be limited by the above embodiments. Rather, the present invention is to be defined by the below claims.

We claim:

1. An apparatus for cotton ginning comprising:
a belt;
and one or more rollers;
wherein the belt and the one or more rollers are operatively connected and the belt is configured to have an arced contoured surface that is operative to apply a uniform normal force to cotton fibers such that unprocessed cotton is processed so that cotton seeds are separated from cotton fiber; and the cotton fiber is held by the arced contoured surface.

2. The apparatus of claim 1, wherein the apparatus comprises a plurality of rollers and a plurality of belts.

3. The apparatus of claim 2, wherein the apparatus comprises at least four rollers and four belts and at least two of the belts create the arced contoured surface.

4. The apparatus of claim 1, further comprising a nip roller.

5. The apparatus of claim 1, wherein the apparatus comprises a plurality of belts and at least one of the plurality of belts is a feed belt.

6. The apparatus of claim 5, further comprising at least one motor.

7. The apparatus of claim 6, wherein at least one of the at least one motor is used to drive the feed belt.

8. The apparatus of claim 1, further comprising at least one motor.

9. The apparatus of claim 4, wherein the nip roller is used to effectively separate the cotton seeds from the cotton fiber.

10. The apparatus of claim 1, further comprising at least one of an air compressor, a means of generating a vacuum, or a mechanical feeder.

11. The apparatus of claim 10, wherein the air compressor, the means of generating a vacuum, or the mechanical feeder are configured to feed the unprocessed cotton to a feed belt.

12. A method of cotton ginning comprising:
feeding unprocessed cotton into an apparatus that contains at least two belts wherein two of the at least two belts are operatively connected to each other so as to generate an arced contour and wherein the arced contour applies a normal force to cotton fibers allowing separation of the cotton fibers from cotton seeds.

13. The method of claim 12, wherein the at least two belts undergo rotation by at least two rollers that are operatively connected to the at least two belts.

14. The method of claim 13, wherein the at least two rollers undergo rotation by one or more motor(s) that is/are operatively connected to the at least two rollers.

15. The method of claim 14, wherein the at least two rollers rotate at essentially the same rotational rate.

16. The method of claim 15, wherein the rotational-rate is approximately 1700 revolutions per minute.

17. The method of claim 14, further comprising a nip roller.

18. The method of claim 17, wherein the nip roller is of a size that allows passage of cotton fibers but not of cotton seeds into the arced contour.

19. The method of claim 18, wherein about 90 percent or more of the cotton fibers are separated from the cotton seeds.

20. The method of claim 19, wherein about 50 percent or more of the cotton fibers are $^{35}/_{32}$ inches or longer.

* * * * *